US010426221B2

(12) United States Patent
Leedy et al.

(10) Patent No.: US 10,426,221 B2
(45) Date of Patent: Oct. 1, 2019

(54) METHOD AND APPARATUS FOR DYNAMICALLY ALTERING A HEIGHT OF A SOLE ASSEMBLY

(71) Applicant: NIKE, Inc., Beaverton, OR (US)

(72) Inventors: Gregory R. Leedy, Beaverton, OR (US); Nam Lu, Beaverton, OR (US); Geng Luo, Portland, OR (US); Sam Strickling, Beaverton, OR (US); Alex Wiley, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 202 days.

(21) Appl. No.: 15/400,216

(22) Filed: Jan. 6, 2017

(65) Prior Publication Data

US 2017/0196301 A1 Jul. 13, 2017

Related U.S. Application Data

(60) Provisional application No. 62/276,293, filed on Jan. 8, 2016.

(51) Int. Cl.

| | |
|---|---|
| ***A43B 7/16*** | (2006.01) |
| ***A43B 7/14*** | (2006.01) |
| ***A43B 13/14*** | (2006.01) |
| ***A43B 13/18*** | (2006.01) |

(52) U.S. Cl.

CPC ..... *A43B 7/16* (2013.01); *A43B 7/144* (2013.01); *A43B 13/148* (2013.01); *A43B 13/181* (2013.01); *A43B 13/187* (2013.01); *A43B 13/188* (2013.01)

(58) Field of Classification Search

CPC ..... A43B 7/16; A43B 7/24; A43B 13/148; A43B 13/181

USPC ..... 36/81, 12, 36 R, 42; 280/624, 632

See application file for complete search history.

(56) References Cited

U.S. PATENT DOCUMENTS

| | | | | |
|---|---|---|---|---|
| 1,516,425 A | | 11/1924 | Dvilnsky | |
| 1,593,915 A | * | 7/1926 | Ringler | A43B 21/39 36/36 R |
| 2,171,045 A | * | 8/1939 | Ohstrom | A43C 13/02 36/36 R |
| 2,509,423 A | | 5/1950 | Cramer | |
| 3,630,538 A | * | 12/1971 | Klein | A63C 9/08 280/623 |
| 3,673,714 A | | 7/1972 | Procopio | |
| 4,064,642 A | * | 12/1977 | Vykukal | A43B 7/125 36/117.8 |
| 4,214,384 A | * | 7/1980 | Gonzalez | A43B 21/39 36/36 R |

(Continued)

FOREIGN PATENT DOCUMENTS

| | | |
|---|---|---|
| FR | 2 750 881 A1 | 1/1998 |
| GB | 2 200 030 A | 7/1988 |

*Primary Examiner* — Shaun R Hurley
*Assistant Examiner* — Bao-Thieu L Nguyen
(74) *Attorney, Agent, or Firm* — Banner & Witcoff, Ltd.

(57) ABSTRACT

A method and apparatus for dynamically altering a height of a sole assembly of an article of footwear uses an actuator having a retraction assembly and a traction assembly. A wedge is moved to different positions within a groove formed in the sole assembly. A user evaluates the performance of the footwear with the wedge at different positions while performing an activity. The user evaluations help determine an optimal height of the sole assembly.

14 Claims, 5 Drawing Sheets

(56) References Cited

U.S. PATENT DOCUMENTS 4,265,033 A * 5/1981 Pols ..... A43B 7/00 36/110
4,358,131 A * 11/1982 Schwartz ..... A63C 9/20 280/614
4,391,048 A * 7/1983 Lutz ..... A43B 1/0036 36/28
4,401,318 A * 8/1983 Beyl ..... A63C 9/001 280/625
4,523,395 A * 6/1985 Borsoi ..... A43B 5/0441 36/117.5
4,566,206 A * 1/1986 Weber ..... A43B 21/26 36/27
4,805,319 A * 2/1989 Tonkel ..... A43B 13/181 36/28
4,942,677 A * 7/1990 Flemming ..... A43B 13/187 36/27
5,203,095 A 4/1993 Allen
5,237,760 A * 8/1993 Altman ..... A43B 1/0036 36/103
5,373,649 A * 12/1994 Choi ..... A43B 21/37 36/36 R
5,419,060 A * 5/1995 Choi ..... A43B 21/48 36/36 R
5,437,110 A 8/1995 Goldston et al.
5,732,481 A 3/1998 Farhad
5,875,567 A 3/1999 Bayley
5,879,020 A * 3/1999 Buquet ..... A63C 9/005 280/633
5,925,000 A * 7/1999 Marciniak ..... A43B 7/24 482/8
5,956,869 A * 9/1999 Kim ..... A43B 13/20 36/28
6,017,128 A * 1/2000 Goldston ..... A43B 1/0036 36/137
6,026,596 A * 2/2000 Seidel ..... A43B 5/0405 36/10
6,460,871 B1 * 10/2002 Dodge ..... A63C 10/10 280/14.22
6,711,835 B1 * 3/2004 Militello ..... A43B 21/42 36/36 B
8,746,728 B2 * 6/2014 Shute ..... A63C 7/1013 280/607
8,820,772 B2 * 9/2014 Andersson ..... A63C 9/006 280/614
8,876,123 B2 * 11/2014 Bradshaw ..... A63C 1/04 280/11.3
8,919,805 B2 * 12/2014 Giordani ..... A63C 9/006 280/614
9,016,712 B2 * 4/2015 Giordani ..... A63C 9/006 280/614
9,022,410 B2 * 5/2015 Giordani ..... A63C 9/006 280/614
9,032,644 B1 * 5/2015 Koo ..... A43B 5/00 36/30 R
9,242,167 B2 * 1/2016 Shute ..... A63C 7/102
9,962,595 B2 * 5/2018 Ibach ..... A43B 5/0496
10,010,782 B2 * 7/2018 Damiani ..... A63C 10/08
2001/0042320 A1 * 11/2001 Lindqvist ..... A43B 7/081 36/27
2005/0066543 A1 * 3/2005 Rosen ..... A43B 3/18 36/7.5
2005/0198867 A1 * 9/2005 Labbe ..... A43B 11/00 36/50.1
2006/0075657 A1 * 4/2006 Chu ..... A43B 13/181 36/28
2007/0045987 A1 * 3/2007 Shute ..... A63C 7/1026 280/611
2007/0261180 A1 * 11/2007 Kaufman ..... A43B 3/108 12/142 R
2010/0146817 A1 6/2010 Crispo
2010/0180474 A1 * 7/2010 Clark ..... A43B 3/00 36/3 B
2010/0229422 A1 * 9/2010 Goonetilleke ..... A61B 5/1074 36/43
2010/0242308 A1 * 9/2010 Belles ..... A43B 3/0026 36/132
2011/0203138 A1 * 8/2011 Shute ..... A63C 7/1013 36/92
2012/0047770 A1 * 3/2012 Dean ..... A43B 21/30 36/103
2013/0181427 A1 * 7/2013 Fritschi ..... A63C 9/007 280/614
2014/0134378 A1 * 5/2014 Downs ..... A43B 23/0225 428/57
2014/0350446 A1 * 11/2014 Gunnsteinsson ..... A61F 5/0111 602/27
2015/0164182 A1 * 6/2015 Threlfall ..... A43B 3/00 36/136
2015/0201704 A1 * 7/2015 Huber ..... A43B 3/246 36/25 R
2015/0230555 A1 * 8/2015 Saint Louis ..... A43B 21/42 36/39
2015/0231449 A1 * 8/2015 Ortwig ..... A63B 31/11 441/61
2016/0089592 A1 * 3/2016 Damiani ..... A63C 10/08 280/611
2016/0302530 A1 * 10/2016 Smith ..... A43C 11/004
2016/0374427 A1 * 12/2016 Zahabian ..... A43B 3/0036 36/102
2018/0133555 A1 * 5/2018 Ortwig ..... A43B 5/08
2018/0228242 A1 * 8/2018 Davenport ..... A43B 3/246

* cited by examiner

METHOD AND APPARATUS FOR DYNAMICALLY ALTERING A HEIGHT OF A SOLE ASSEMBLY

RELATED APPLICATIONS

This application claims priority to U.S. Provisional Application Ser. No. 62/276,293, filed on Jan. 8, 2016, which is incorporated herein by reference in its entirety.

FIELD

Aspects of this invention relate generally to a method and apparatus for use in dynamically altering a height of a sole assembly of an article of footwear, and, in particular, to the use of a wedge inserted into a groove formed in the sole assembly in order to perform such a dynamic alteration.

BACKGROUND

Conventional articles of athletic footwear include two primary elements, an upper and a sole assembly. The upper provides a covering for the foot that comfortably receives and securely positions the foot with respect to the sole assembly. In addition, the upper may have a configuration that protects the foot and provides ventilation, thereby cooling the foot and removing perspiration. The sole assembly is secured to a lower portion of the upper and is generally positioned between the foot and the ground. In addition to attenuating ground reaction forces, the sole assembly may provide traction, control foot motions (e.g., by resisting over pronation), and impart stability, for example. Accordingly, the upper and the sole assembly operate cooperatively to provide a comfortable structure that is suited for a wide variety of activities, such as walking and running. An insole may be located within the upper and adjacent to a plantar (i.e., lower) surface of the foot to enhance footwear comfort, and is typically a thin, compressible member.

The sole assembly may incorporate multiple layers. Some footwear includes only a midsole, while others may also include an outsole secured to a bottom surface of the midsole. The midsole, which is conventionally secured to the upper along the length of the upper, is primarily responsible for attenuating ground reaction forces. The midsole may also form the ground-contacting element of footwear. In such embodiments, the midsole may include texturing, such as projections and recesses or grooves, in order to improve traction. The outsole, when present, forms the ground-contacting element and may be fashioned from a durable, wear-resistant material.

The midsole may be primarily formed from a resilient, polymer foam material, such as ethyl vinyl acetate (EVA), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

The height of the heel portion of an article of footwear can be altered. Varying the heel height can affect performance and comfort, and is impacted by the user's stride pattern and physical attributes. It would be desirable to be able to alter the heel height for a user based on feedback from the user, that is, through subjective evaluation, and/or based on performance measurements, that is, through objective evaluation. Consequently, the heel height can be customized for that particular user.

Figure 1:
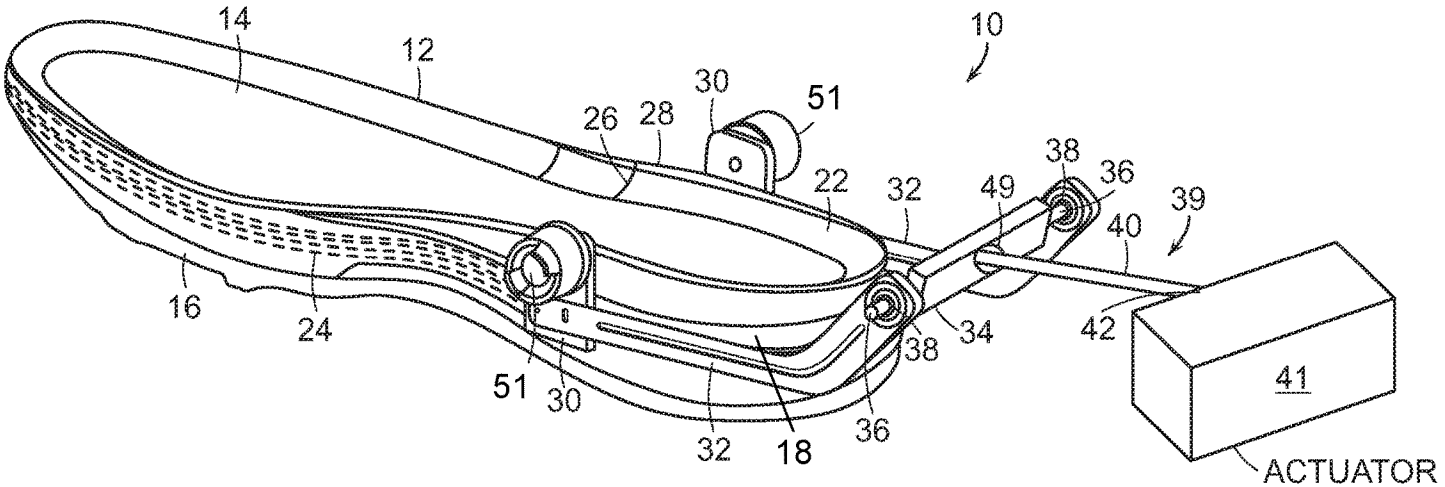
FIG. 1 is a perspective view of an actuator in position on a sole assembly of an article of footwear.

The figures referred to above are not drawn necessarily to scale, should be understood to provide a representation of particular embodiments of the invention, and are merely conceptual in nature and illustrative of the principles involved. Some features of the actuator used to dynamically alter a heel height of a sole assembly depicted in the drawings have been enlarged or distorted relative to others to facilitate explanation and understanding. The same reference numbers are used in the drawings for similar or identical components and features shown in various alternative embodiments. Different embodiments of the actuator used to dynamically adjust the heel height of a sole assembly would have configurations and components determined, in part, by the intended application and environment in which they are used.

DETAILED DESCRIPTION OF CERTAIN EXEMPLARY EMBODIMENTS

The principles of the invention may be used to advantage to provide an effective method and apparatus for dynamically determining an optimal heel height for an article of footwear for a particular user. It would be desirable to be able to dynamically alter the hell height of an article of footwear for a user in order to customize the footwear for a particular user and/or particular activities to be performed with the footwear.

In accordance with a first aspect, a method of dynamically altering a height of a sole assembly of an article of footwear includes positioning a wedge at a first distance from a front of a groove formed in a rear surface of a sole assembly of an article of footwear with an actuator so as to create a first heel height for the sole assembly. A user is allowed to perform an activity using the article of footwear with the wedge positioned at the first distance. Performance of the footwear with this first heel height is then evaluated.

The wedge is then positioned with the actuator so that it is positioned at a second distance from the front of the groove so as to create a second heel height for the sole assembly. The article of footwear with the wedge positioned at the second distance is then evaluated with the subjective and/or objective measurements and compared to the results with the wedge at the first distance. This process can be repeated over and over numerous times with the wedge at different distances from the front of the groove.

In accordance with another aspect, a retractor for an article of footwear includes a retraction assembly configured to pull a wedge rearwardly within a groove formed in a sole assembly of an article of footwear; and a spring configured to provide tension in a forward direction on the wedge positioned in the groove.

By providing a way of dynamically altering the heel height of a sole assembly, footwear that is optimized for a particular user can be designed and produced. These and additional features and advantages will be apparent to those skilled in the art, that is, those who are knowledgeable or experienced in this field of technology, in view of the following disclosure of the invention and detailed description of certain exemplary embodiments.

A wedge adjustment assembly 10 for use with a sole assembly 12 of an article of footwear is depicted in FIG. 1. It is to be appreciated that in certain embodiments, sole assembly 12 may be a midsole 14, with an outsole 16 being secured to the bottom surface of the midsole. In other embodiments, the bottom surface of midsole 14 can serve as the ground-engaging portion (or other contact surface-engaging portion) of the article of footwear. Sole assembly 12 is secured in known fashion to an upper of the article of footwear as shown in FIG. 2.

Wedge adjustment assembly 10 is used to move a wedge 18 within a slot or groove 20 (groove 20 seen more clearly in FIG. 2) formed in a heel portion 22 of sole assembly 12 of an article of footwear 23. In the illustrated embodiment, groove 20 is formed in midsole 14. Groove 20 may extend completely laterally through midsole 14 and longitudinally through heel portion 22 from a rearmost location on midsole 14 to a position proximate a midfoot portion 24 of midsole 14, transversely bisecting heel portion 22 into an upper portion 25 and a lower portion 27, with the space or gap formed therebetween being groove 20. As seen here, sole assembly 12 may have a heel height H.

Figure 2:
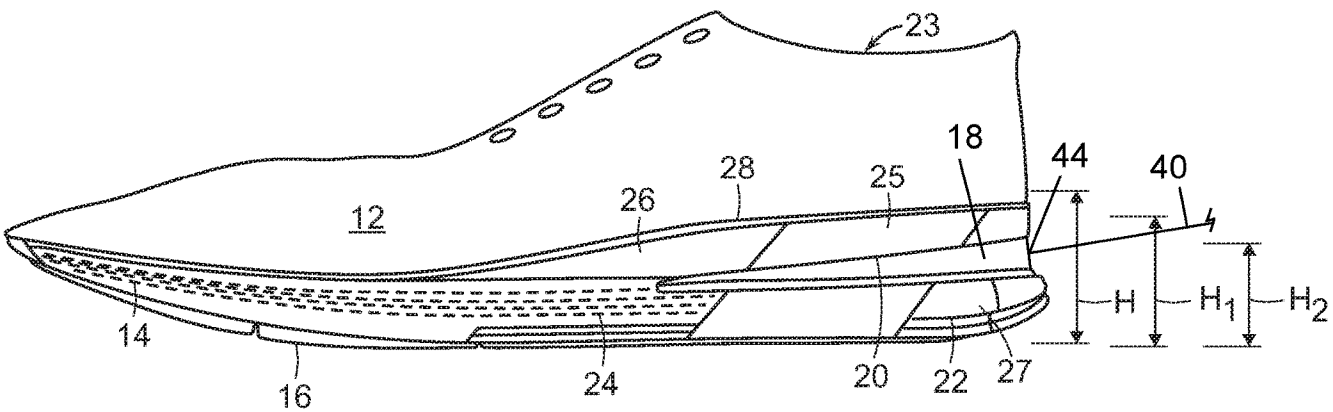
FIG. 2 is an elevation view of the sole assembly of FIG. 1.

In certain embodiments, as seen in FIGS. 1-2, slots 26 may be formed in a peripheral edge 28 of midsole 14 allowing the portion of midsole 14 above groove 20 to flex more easily.

As seen in FIG. 1, wedge adjustment assembly 10 may include a frame 30 to which a pair of side rails 32 may be secured. A cable guide 34 may be mounted to side rails 32. In the illustrated embodiment, a pin 36 extends outwardly from each end of cable guide 34, and is received in an aperture 38 formed in a rear end of side rail 32.

Figure 3:
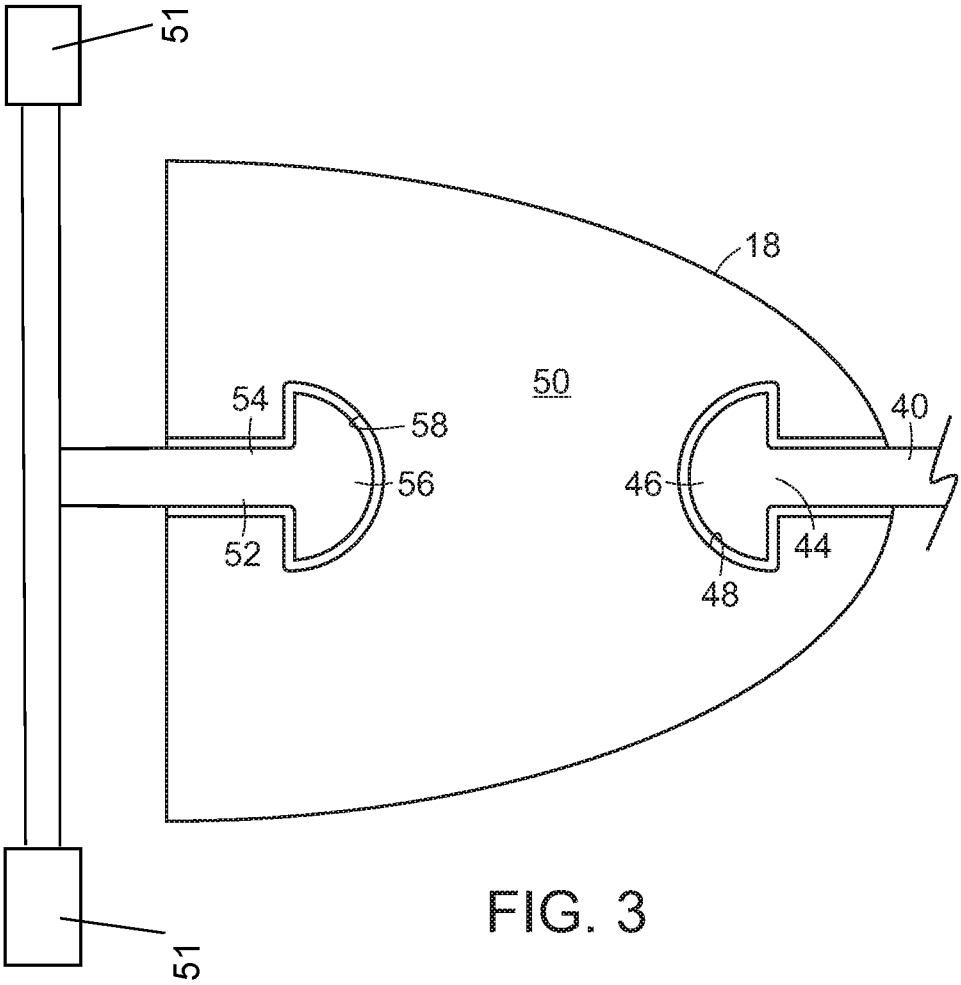
FIG. 3 is an elevation view of the bottom of the wedge used with the actuator of FIG. 1.

Wedge adjustment assembly 10 may include a retraction assembly or retractor 39 that can be used to move wedge 18 rearwardly within groove 20. Retractor 39 may include a first, or retraction cable 40. First cable 40 may extend through cable guide 34 and be secured at a first end 42 thereof to an actuator 41. As seen in FIG. 2 and FIG. 3, a second end 44 of first cable 40 may be secured to wedge 18. A projection 46 may be positioned at second end 44 of first cable 40 and received in a mating recess 48 formed in a bottom surface 50 of wedge 18. As seen in FIG. 1, first cable 40 may extend through an aperture 49 formed on cable guide 34. Actuator 41 serves to provide tension on first cable 40, pulling it through cable guide 34 and thereby pulling wedge 18 rearwardly within groove 20.

In certain embodiments, actuator 41 may be a hand lever, similar to that often used in a brake assembly on a bicycle. Actuator 41 may be any type of lever or coiling mechanism that serves to pull first cable 40 rearwardly, thereby pulling wedge 18 rearwardly through groove 20. Other suitable mechanisms that will serve as an actuator to pull first cable 40 rearwardly will become readily apparent to those skilled in the art, given the benefit of this disclosure.

A spring assembly 51 may include a second, or tension, cable 52, and a first end 54 of second cable 52 may also be secured to wedge 18. A projection 56 may be positioned at second end first end 54 of second cable 52 and received in a mating recess 56 formed in bottom surface 50 of wedge 18. Spring assembly 51 serves to provide tension on the forward end of wedge 18 when it is in groove 20, prevention wedge 18 from sliding rearwardly and out of groove 20. Thus, retractor 39 and spring assembly 51 may use first and second cables 40,52 to move wedge 18 forward and backward within groove 20 of sole assembly 12.

It is to be appreciated that in certain embodiments springs or rods may be used in place of first and second cables 40, 52. Other assemblies for providing tension and a pulling force on wedge 18 will become readily apparent to those skilled in the art, given the benefit of this disclosure.

It is to be appreciated that first and second cables 40, 52 may be anchored to wedge 18 in a variety of ways other than by way of projections 46, 56 and corresponding recesses 48, 56. Other suitable ways of anchoring first and second cables 40, 52 to wedge 18 will become readily apparent to those skilled in the art, given the benefit of this disclosure.

Spring assembly 51 may include spring sub-assemblies 50 that are connected to second cable 52 through frame 30, providing tension or resistance that serves to keep wedge 18 from moving rearwardly while a user is wearing footwear 23.

In use, a user puts their foot in footwear 23 and wedge 18 is moved to a first position within groove 20 at a first distance rearward of a front of groove 20. This can be done by the user themselves or by an operator of actuator 10. In the illustrated embodiment, wedge 18 is moved by hand by the user or the operator. First cable 40 may be used as a retraction member that serves to move wedge 18 rearwardly within groove 20. Second cable 52 may be used as a tensioning member that helps retains wedge 18 at the first position within groove 20, acting against the tendency for wedge 18 to move rearwardly within groove 20 when the user is actively using the footwear.

It is to be appreciated that heel height H varies depending on the location at which wedge 18 is positioned within groove 20. As wedge 18 is moved rearwardly, sole assembly will have a heel height H1 that is smaller than heel height H with wedge 18 fully inserted into groove 20. This is due to the fact that the thickest portion of wedge 18, that is, its rearmost portion, is moved outwardly beyond the rear end of sole assembly 12, thereby allowing the portion of sole assembly 12 above groove 20 to move downwardly. The further back that wedge 18 is moved, the smaller that heel height H will be.

The user then performs an activity with wedge 18 in the first position such as running on a treadmill, for example. It is to be appreciated that the user may perform any activity while wearing article of footwear 23 in conjunction with the use of actuator 10. For example, the user could play a sport such as basketball, or perform moves likely to be encountered in a sport such as quick lateral starts and stops, and/or jumping. It is to be appreciated that activities of all levels could be performed by the user while using footwear 23 with actuator 10.

After the user has performed the activity with wedge 18 in the first position, the user evaluates the results of their performance wearing the footwear with wedge 18 in the first position. This evaluation can include a subjective evaluation performed by the user, which allows the user to evaluate the footwear with respect to comfort, fit, and performance, for example. The evaluation can also include an objective evaluation of various performance characteristics. Such performance characteristics can include metabolic output, $VO_2$ max, kinematic force, gain in stride length, reaction time, force, foot strike pattern, and alpha/beta brain waves, for example. It is to be appreciated that any performance characteristic can be measured in such an objective evaluation of the footwear. Other suitable performance characteristics will become readily apparent to those skilled in the art, given the benefit of this disclosure. Further, it is to be appreciated that any combination of subjective and objective measurements can be used to evaluate the footwear.

The subjective and/or objective evaluations may also be recorded by the user or another individual monitoring the evaluation of the process. The recording can be done manually, in a notebook for example, or it may be recorded digitally through the use of a personal computer, a smartphone, or any other desired electronic device.

Wedge 18 may then be moved to a second position within groove 20 at a second distance behind a front of groove 20, which provides a second heel height H2. The user then performs an activity with wedge 18 in the second position, and then the performance of the footwear with this heel height is measured with the subjective and/or objective evaluations. In certain embodiments, this activity may be the same activity as that performed when wedge 18 was in the first position. The evaluation of wedge 18 in the second position may be recorded as well.

Wedge 18 may then be moved to any number of additional positions within groove 20, with corresponding subjective and/or objective evaluations being conducted at each position. Moving wedge 18 along groove 20 to multiple positions, and then performing an activity with a new adjusted heel height allows the user and/or other observer(s) to quickly evaluate the performance and feel of the footwear with different heel heights. This dynamic altering of heel height H allows the user and/or an individual that is assisting the user to determine the optimum heel height H for the user, whether it be for general usage or for a particular activity.

It is also to be appreciated that in certain embodiments, an actuator could be retained on the footwear during use, allowing dynamic altering of the height of the heel during use. For example, when a user is engaged in a prolonged activity while using the footwear, such as running a marathon, they may tire, which may result in a change in their stride. Having the actuator on the footwear during use would allow the wedge to be moved within the groove dynamically, thereby accommodating the change in stride.

Figure 4:
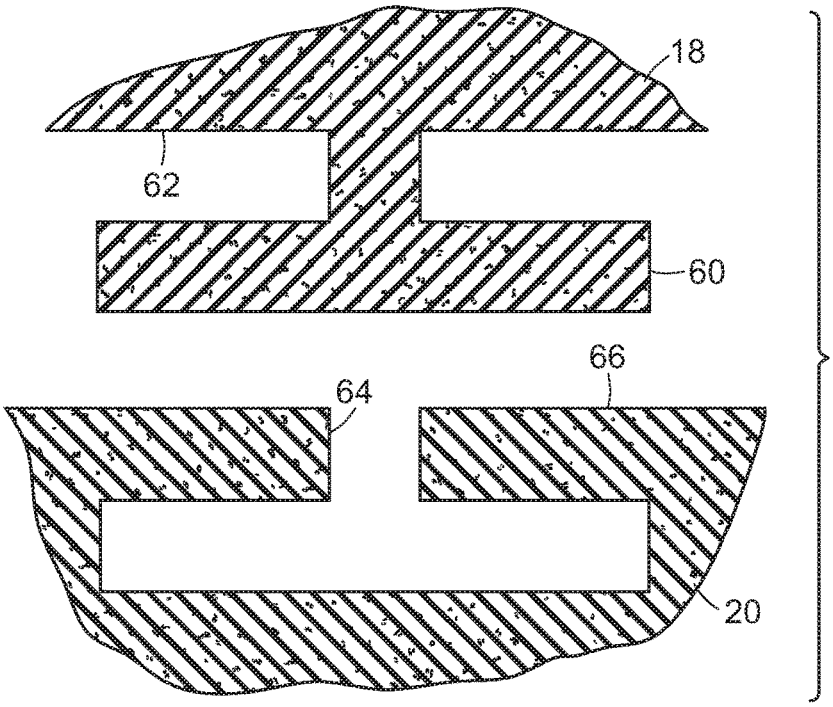
FIG. 4 is a section view, partially broken away, of an alternative embodiment of a wedge for use with the actuator and sole assembly of FIG. 1, having a projection on the wedge to be received in a mating recess in the sole assembly.

In certain embodiments, as seen in FIG. 4, a projection 60 may extend outwardly from a lower surface 62 of wedge 18, and may be slidingly received in a mating recess 64 formed in a surface 66 of groove 20. In the illustrated embodiment, projection 60 and recess 64 are T shaped. It is to be appreciated that projection 60 and mating recess 64 can take on any desired shape.

The sliding engagement of projection 60 within recess 64 allows wedge 18 to easily move forward and back within groove 20, but limits later movement of wedge 18 with respect to groove 12.

Figure 5:
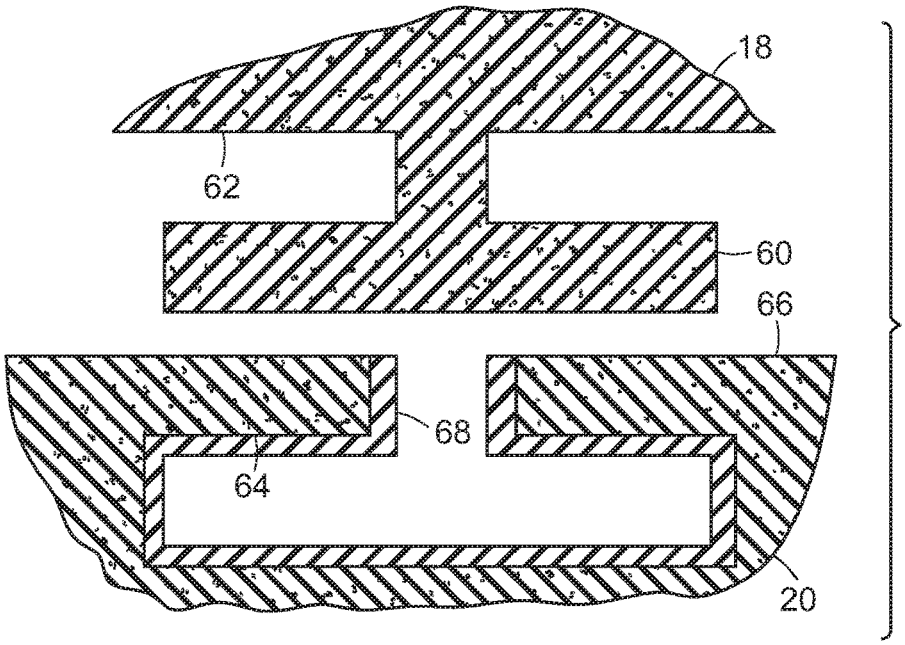
FIG. 5 is a section view, partially broken away, of another embodiment of a wedge for use with the actuator and sole assembly of FIG. 1, having a projection on the wedge to be received in a mating recess in the sole assembly.

In certain embodiments, as seen in FIG. 5 a liner 68 may be seated within recess 64, with projection 60 being received within liner 68. Liner 68 may provide a surface with less friction than that of recess 64 itself. Liner 68 may include a polymer layer on its surface, such as polytetrafluoroethylene (PTFE, which is also known as Teflon®, provided by DuPont). In certain embodiments the entire liner may be formed of a polymer. Liner 68 may be formed of, or have a layer of, ceramic or any other desired material that will help reduce friction. Liner 68 and or recess 64 itself also may be coated with a liquid lubricant to help reduce friction.

Figure 6:
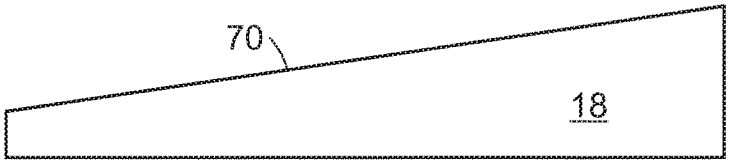
FIG. 6 is a side elevation view of the wedge used with the actuator and sole assembly of FIG. 1.
Figure 7:
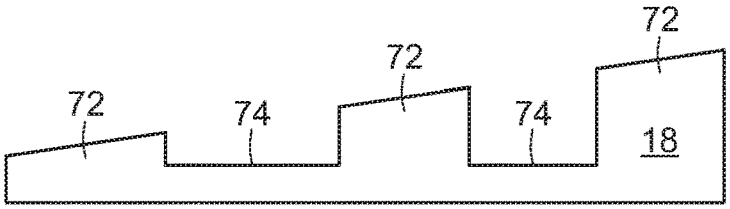
FIG. 7 is a side elevation view of an alternative embodiment of the wedge of FIG. 6.
Figure 8:
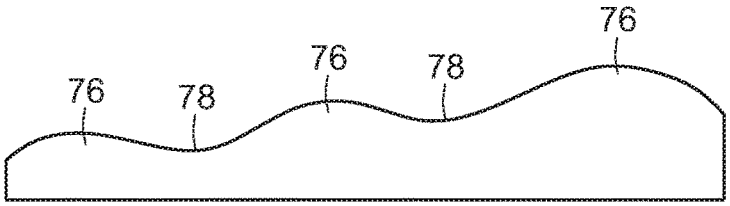
FIG. 8 is a side elevation view of another alternative embodiment of the wedge of FIG. 6.

It is to be appreciated that wedge 18 can take on any desired profile. As illustrated in FIG. 6, an upper surface 70 of wedge 18 may be sloped upwardly from a front portion to a rear portion of wedge 18 in linear fashion. As illustrated in FIG. 7, wedge 18 may be sloped upwardly in stepped fashion and include a plurality of raised steps or portions 72 spaced from one another by lowered portions 74. Thus, the wedge includes a plurality of steps spaced from one another, with a height of each step being larger than a height of the step in front of it and smaller then a height of the step behind it. In another embodiment, as seen in FIG. 8, wedge 18 may have a wave-shaped profile including alternating crests 76 and troughs 78. The alternate profiles of wedge 18 seen in FIGS. 7-8 allow for more compression of wedge 18 as it is moved rearwardly through groove 20 and its highest regions, at the rear end of wedge 18, are moved out of groove 20.

Figure 9:
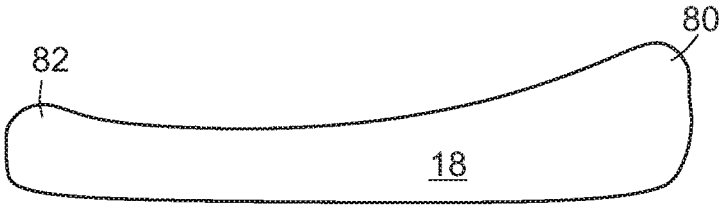
FIG. 9 is a rear elevation view of an alternative embodiment of the wedge of FIG. 6.

It is to be appreciated that the profile of wedge 18 when viewed from the rear can be varied as well. For example, as seen in FIG. 9, the lateral side 80 of wedge 18 can be higher than that of the medial side 82. Forming wedge 18 in this manner may provide additional support of the user's heel strike. It is to be appreciated that the profile of wedge 18 can be varied in three directions, namely front-to-back, up and down, and laterally from left to right. Thus, for example, wedge 18 may be the thickest at the rear lateral corner, supporting heel strike, and may decrease in thickness toward an front and toward a medial side of wedge 18.

It is to be appreciated that wedge 18 may be formed of any desired material. In certain embodiments, wedge 18 is formed of same material as that of sole assembly 12. It is to be appreciated that wedge 18 may also be formed of a material different than that of sole assembly 12. For example, wedge 18 may be formed of polyurethane (PU) or ethyl vinyl acetate (EVA).

Figure 10:
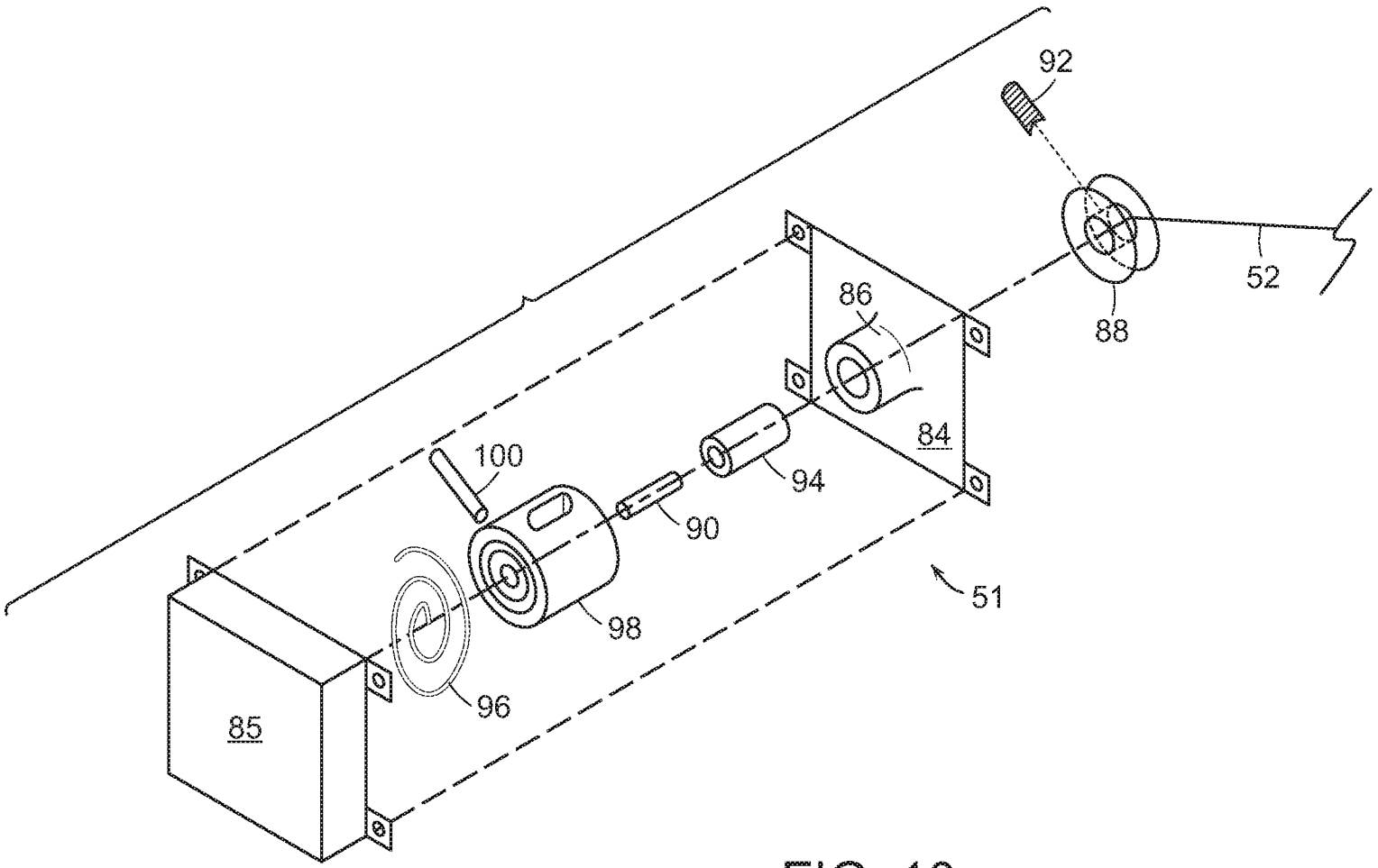
FIG. 10 is an exploded view of an alternative embodiment of a tension assembly for use with the actuator of FIG. 1.

In certain embodiments, spring assembly 51 may include a spiral spring that cooperates with a spool to provide tension to second cable 52. As seen in exploded form in FIG. 10, spring assembly 51 may include a housing 84 and cover member 85 securable to housing 84, A hub 86 may extend outwardly from housing 84. Second cable 52 may be windable about a spool 88 that is rotatably supported on a shaft 90. Second cable 52 may be anchored to spool 88 with a set screw 92.

Shaft 90 may be received in a bearing 94 that may be seated within hub 86. Bearing 94 may be a ball bearing assembly or a plain sleeve bearing. A spiral spring 96 may be anchored to a spring retainer 98, with a set screw 100 anchoring spring retainer 98 to shaft 90. Spiral spring 96 acts to create tension in known fashion on spool 88 and, therefore, second cable 52, helping prevent wedge 18 from inadvertently sliding rearwardly through groove 20.

Other mechanisms other than the first and second cables and associated spring assemblies discussed above may be used to serve as the retractor and spring assembly to control the movement of wedge 18 within groove 20. For example the retractor and spring assembly could include rods or other elements that are more rigid than a cable, but still are resilient and flexible enough to be positioned within the article of footwear during use.

In other embodiments, the movement of wedge 18 along groove 20 could be automated. For example, stepper motors could be used to move wedge 18 forward and backward within groove 20 a desired distance. The stepper motors could be controlled with any desired electronic device. Other suitable retractors and spring assemblies and corresponding control assemblies will become readily apparent to those skilled in the art, given the benefit of this disclosure.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An actuator assembly for an article of footwear comprising:

a wedge having an anterior end, a posterior end, and an inclined upper surface extending upwardly from the anterior end to the posterior end;

a retractor connected to a rear portion of the wedge and configured to pull the wedge rearwardly within a groove formed in a sole assembly of an article of footwear; and a spring assembly connected to a front portion of the wedge and configured to provide tension in a forward direction on the wedge positioned in the groove.

2. The actuator assembly of claim 1, wherein the retractor includes a first cable, a first end of the first cable being secured to an actuator configured to pull the first cable rearwardly.

3. The actuator assembly of claim 2, wherein the retractor includes a frame and a cable guide supported on the frame, the first cable extending through the cable guide.

4. The actuator assembly of claim 2, wherein a second end of the first cable is secured to the wedge.

5. The actuator assembly of claim 1, wherein the spring assembly is configured to retain the wedge at different positions within the groove.

6. The actuator assembly of claim 5, wherein the spring assembly includes a second cable having a first end secured to the wedge.

7. The actuator assembly of claim 6, wherein a second end of the second cable is secured to the spring assembly.

8. The actuator assembly of claim 1, wherein the wedge includes a projection configured to be slidably received in a recess formed in a sole assembly.

9. The actuator assembly of claim 8, wherein the wedge is T-shaped when viewed from a rear of the wedge.

10. The actuator assembly of claim 1, wherein a liner is seated in the recess, and the wedge includes a projection configured to be slidably received in the liner.

11. The actuator assembly of claim 10, wherein the liner is formed of a polymer.

12. The actuator assembly of claim 10, wherein the liner is formed of polytetrafluoroethylene.

13. The actuator assembly of claim 10, wherein the liner is formed of a ceramic material.

14. The actuator assembly of claim 1, wherein the wedge has a linear slope.

* * * * *